US009878432B2

(12) United States Patent
Linehan et al.

(10) Patent No.: US 9,878,432 B2
(45) Date of Patent: Jan. 30, 2018

(54) CORDLESS POWER TOOLS WITH A UNIVERSAL CONTROLLER AND TOOL AND BATTERY IDENTIFICATION

(75) Inventors: John J. Linehan, Jamison, PA (US); Daniel Becker, Monroe Township, NJ (US); Joshua Odell Johnson, Allentown, PA (US)

(73) Assignee: Ingersoll-Rand Company, Davidson, NC (US)

( * ) Notice: Subject to any disclaimer, the term of this patent is extended or adjusted under 35 U.S.C. 154(b) by 1013 days.

(21) Appl. No.: 13/883,223

(22) PCT Filed: Nov. 4, 2011

(86) PCT No.: PCT/US2011/059265

§ 371 (c)(1),
(2), (4) Date: Jun. 6, 2013

(87) PCT Pub. No.: WO2012/061673

PCT Pub. Date: May 10, 2012

(65) Prior Publication Data

US 2013/0255980 A1 Oct. 3, 2013

Related U.S. Application Data

(60) Provisional application No. 61/410,260, filed on Nov. 4, 2010.

(51) Int. Cl.

| | |
|---|---|
| ***B25F 5/00*** | (2006.01) |
| ***B25F 5/02*** | (2006.01) |
| *B25F 3/00* | (2006.01) |

(52) U.S. Cl.

CPC ..... *B25F 5/00* (2013.01); *B25F 5/02* (2013.01); *B25F 3/00* (2013.01); *Y10T 29/49002* (2015.01)

(58) Field of Classification Search

CPC ..... H02J 2007/0098; B25F 5/00; B25F 5/001; B25F 3/00; B25F 5/02; B25B 21/008;

(Continued)

(56) References Cited

U.S. PATENT DOCUMENTS 3,761,663 A * 9/1973 Brown ..... H01H 9/061 200/327
5,538,423 A * 7/1996 Coss ..... A61C 1/0015 408/8

(Continued)

FOREIGN PATENT DOCUMENTS

CN 1328903 A 1/2002
CN 2821879 Y 9/2006

(Continued)

OTHER PUBLICATIONS

International Preliminary Report dated May 7, 2013 from International Patent Application No. PCT/US2011/059265 filed Nov. 4, 2011.

(Continued)

*Primary Examiner* — Stephen F Gerrity
*Assistant Examiner* — Joshua Kotis
(74) *Attorney, Agent, or Firm* — Sunstone IP

(57) ABSTRACT

A handheld power tool having an electric motor held in a power tool body and a universal controller in the power tool body in communication with the electric motor. The universal controller is in communication with an electronic component that defines a tool type identifier in the power tool body. The handheld power tool also has a battery pack releasably attachable to the power tool body, the battery pack having an on-board electronic identifier. The universal controller has a plurality of different operational control modes for a plurality of different tool types and a plurality of different battery packs with different battery characteris- (Continued)

tics. The controller can automatically select an appropriate control mode based on the tool type identifier and the battery pack identifier.

18 Claims, 11 Drawing Sheets

(58) Field of Classification Search
CPC .. B25B 23/147; B25D 16/003; B25D 16/006; B25D 2216/0084; B25D 2216/0092; G05B 15/02
USPC ..... 173/2, 29, 46–48, 171; 320/106
See application file for complete search history.

(56) References Cited

U.S. PATENT DOCUMENTS 6,218,806 B1 * 4/2001 Brotto ..... H02J 7/0004 320/106
6,695,837 B2 * 2/2004 Howell ..... A61B 18/08 606/29
6,913,087 B1 * 7/2005 Brotto ..... B25B 21/00 173/1
7,119,516 B2 * 10/2006 Denning ..... B25F 5/00 320/106
7,508,171 B2 3/2009 Carrier et al.
7,688,028 B2 * 3/2010 Phillips ..... B25F 5/00 320/106
7,719,234 B2 * 5/2010 Carrier ..... B25F 5/00 320/112
7,723,952 B2 * 5/2010 Phillips ..... B25F 5/00 307/150
7,728,553 B2 * 6/2010 Carrier ..... H01M 2/1022 320/116
2005/0073282 A1 * 4/2005 Carrier ..... B25F 5/00 320/106
2006/0234617 A1 * 10/2006 Francis ..... B23D 59/001 452/174
2010/0176766 A1 * 7/2010 Brandner ..... B25F 5/00 320/136
2011/0248653 A1 * 10/2011 Brotto ..... B25F 5/021 318/139
2012/0118595 A1 * 5/2012 Pellenc ..... B25F 3/00 173/46

FOREIGN PATENT DOCUMENTS

CN 201098887 Y 8/2008
CN 201515238 U 6/2010
CN 101784373 A 7/2010
DE 102008003287 A1 7/2008
EP 2033742 A2 3/2009
FR 2920683 A1 * 3/2009 ..... B25F 3/00
JP 4517575 B2 8/2010

OTHER PUBLICATIONS

Office Action dated Sep. 29, 2014 from Chinese Patent Application No. 201180064130.6 filed Nov. 4, 2011.
Office Action dated Jun. 8, 2015 from Chinese Patent Application No. 201180064130.6 filed Nov. 4, 2011.
International Search Report for corresponding PCT Application No. PCT/US2011/059265, dated Jun. 25, 2012.
Supplemental Search Report dated Mar. 8, 2016 from European Patent Application No. 11838851.1.

* cited by examiner

CORDLESS POWER TOOLS WITH A UNIVERSAL CONTROLLER AND TOOL AND BATTERY IDENTIFICATION

RELATED APPLICATIONS

This application is a 35 USC § 371 national phase application of PCT/US2011/059265, filed Nov. 4, 2011, which claims the benefit of and priority to U.S. Provisional Application Ser. No. 61/410,260, filed Nov. 4, 2010, the contents of which are hereby incorporated by reference as if recited in full herein.

FIELD OF THE INVENTION

This invention relates to cordless power tools.

BACKGROUND OF THE INVENTION

Dedicated, different controllers have been used for different power tools to control a respective power tool.

SUMMARY OF EMBODIMENTS OF THE INVENTION

Embodiments of the invention are directed to controllers with tool-specific identifiers that allow for a controller to be used with a plurality of different tool types. The controller may optionally be a trigger switch for a cordless power tool.

Embodiments of the invention are directed to a cordless power tool with a "universal" controller. Stated differently, the controller is configured to be able to operate a plurality of different types of tools and is configured to direct the operational output of a battery according to the type of tool in which that battery is mounted. The controller can be configured to define different performance limits for a respective tool based on the tool type and/or battery in the tool (e.g., screwdriver, drill, impact, grinder, ratchet) using a defined electronic menu or electronic library of tool types correlated to batteries and associated performance parameters.

Some embodiments are directed to handheld power tools. The power tools include: a power tool body; an electric motor held in the power tool body; a universal controller in the power tool body in communication with the electric motor, the universal controller having or being in communication with an electronic component that defines a tool type identifier in the power tool body; and a battery pack releasably attachable to the power tool body, the battery pack having an on-board electronic identifier. The universal controller has a plurality of different operational control modes for a plurality of different tool types and a plurality of different battery packs with different battery characteristics, and wherein the controller automatically selects an appropriate control mode based on the tool type identifier and the battery pack identifier.

The controller can be defined by a trigger switch and the electronic component that defines a tool type identifier can include a resistor held by the trigger switch.

The trigger switch can include a set of terminals and the resistor defining the tool type identifier can be electrically connected to at least one of the terminals.

The tool type identifier can include a resistor and the battery pack identifier can include a resistor. The controller can include a control module that applies a scalar factor to operating parameters based on at least one of the tool type identifier or the battery pack identifier.

The electronic component that defines the tool type identifier can be configured to be attached to a trigger switch during assembly of the power tool such that, during assembly, a respective trigger switch has an open terminal that is reserved for the electronic component that defines the tool type identifier, the trigger switch being in communication with the battery pack.

The power tool can include a pistol handle portion. The tool type identifier can be attached to the universal controller and can reside in the pistol handle. The universal controller can be configured to have at least three of the following: drill, impact, ratchet and screwdriver operational power tool modes.

The universal controller can be configured to identify battery pack and tool type mismatches and prevent operation of the power tool.

A portion of the power tool body can be color-coded to a color associated with the electronic component to aid in proper assembly selection.

The universal controller can be configured to electronically identify a resistor value of a resistor connected to the trigger switch or that forms part of the trigger switch that defines the tool type electronic identifier. The universal controller can be configured to define at least one of a current shutdown limit and time to shutdown that is proportional to the resistor value.

Other embodiments are directed to a trigger switch for a cordless power tool. The trigger switch includes a plurality of terminal inputs configured, during use, to be in electrical communication with terminal inputs on a rechargeable battery pack. At least one of the terminal inputs is configured to be in communication with a tool type electronic identification component. The trigger switch also includes a universal controller in communication with the terminal inputs. The universal controller is configured to electronically identify a tool type of a power tool using the tool type identification component, then select one of a plurality of pre-programmed operational modes based on the identified tool type.

The tool type identification component can include a resistor.

The universal controller can be configured to identify battery pack and tool type mismatches and prevent operation of a power tool having a mismatch.

When assembled to a power tool body, the universal controller can be configured to electronically identify battery characteristics of a rechargeable battery pack attached to the power tool body.

The universal controller can be configured to electronically identify a resistor value of a resistor connected to the trigger switch or that forms part of the trigger switch. The universal controller can be configured to define at least one of a current shutdown limit and time to shutdown that is proportional to the resistor value.

Yet other embodiments are directed to methods of assembling a cordless power tool. The methods include: (a) providing a battery pack useable with a plurality of different power tool types, the battery pack having an on-board identifier that defines battery characteristics; (b) providing a power tool controller useable with a plurality of different power tool types, the controller having a plurality of defined operational modes for different tool types; (c) allowing an assembler to place an electronic, tool type identifier on a control interface switch that is electronically associated with a defined tool type; and (d) electronically selecting an operational mode for the power tool controller based on the tool identifier and the battery pack identifier.

The power tool controller can include or be defined by a trigger switch. The allowing step can be carried out by allowing the assembler to select a resistor having a resistor value that identifies a corresponding tool type to the controller so that the controller can select the correct operational mode.

The method may also include providing a plurality of different resistors having different resistor values and the allowing the assembler to select one that is associated with a respective tool type.

The controller can be configured to identify battery pack and tool type mismatches and prevent operation of the power tool.

A portion of the power tool body can be color-coded to a color associated with a corresponding tool type electronic component. The allowing an assembler step can be carried out by the assembler placing the electronic component with a color that substantially matches the portion of the power tool body on the controller.

The color-coded electronic component can comprise a resistor and the controller is the trigger switch.

Embodiments of the invention allow for a lesser number of inventory of different tool-specific trigger switches and/or batteries.

The foregoing and other objects and aspects of the present invention are explained in detail in the specification set forth below.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DESCRIPTION OF EMBODIMENTS OF THE INVENTION

Figure 1B:
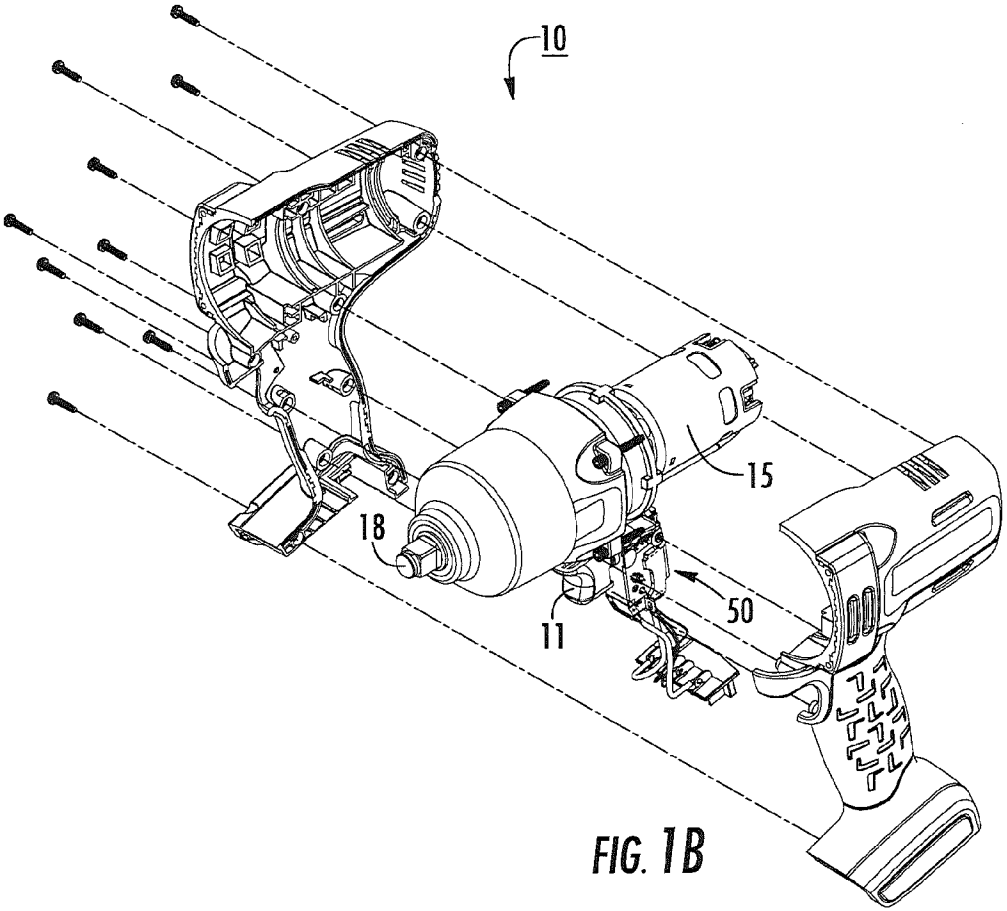
FIG. 1B is an exploded view of the tool shown in FIG. 1A according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof.

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein.

The term "universal" means that the controller can be used for more than one cordless tool type even if the output of that tool is different and is not required to be stored as a specific part number (e.g., stock keeping unit or "SKU"). The controller is a part of the control circuit that directs many operational parameters or control aspects of the tool/motor. The controller can include a microprocessor.

The term trigger or tool "switch" refers to the user accessible device used to operate (e.g., power on or off) the power tool and the associated circuitry and components, typically held in a pistol handle portion of the power tool body. The term "color-coded" means that the so-called components have a color that is the same or sufficiently similar so that the two components are readily visually identifiable as related.

To reduce total lifecycle cost it is desirable to place control functions in the battery powered device as opposed to within the battery, which is consumable. In the interests of economy, it is further desirable to use the same controller across the range of battery powered devices. Thus, a single controller can be configured to control operation of a plurality of different cordless (e.g., battery powered) power tools including, for example, screwdrivers, ratchets, impacts, grinders and the like.

A primary function of the controller is to regulate the energy supplied over time to the process, allowing a maximum duty cycle while protecting internal components. To do this effectively, the controller should know the characteristics of the battery and the tool itself.

Embodiments of the invention provide a low cost method to uniquely identify a set of device characteristics to a single controller at point of device assembly to dedicate protection schemes at that point and to reduce the number of SKU's (different inventory part numbers) that are used.

Embodiments of the invention can also or alternatively provide a low cost, battery-operated cordless power tool component protection system that includes electronic (tool type) identification (ID), battery ID, defined and stored tool operating (control, output, safety or other) parameters, other device characteristics and a control circuit (e.g., controller) that operates the tool in which it is assembled based on the identified tool ID and battery ID with their associated defined characteristics. The controller can automatically select the proper operational mode based on a correlation of tool ID and battery ID to a corresponding defined operating profile.

Embodiments of the invention can provide a low cost method to uniquely identify a set of device characteristics to a single controller at point of device assembly to dedicate protection schemes at that point and to reduce the number of SKU's that must be planned along with a low cost battery operated device protection system that includes, device identification, battery identification, stored device characteristics and moderated controller behavior based on the identified characteristics.

Figure 1A:
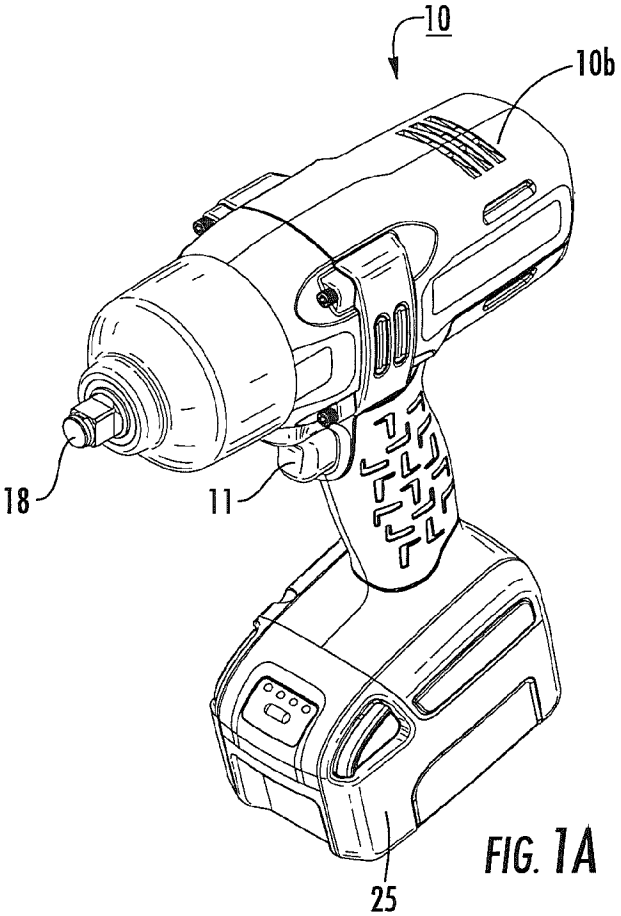
FIG. 1A is front perspective view of an exemplary cordless power tool according to embodiments of the present invention.

Turning now to the figures, FIGS. 1A and 1B illustrate an example of cordless power tool 10 with a power tool body 10*b* that holds a motor 15 that drives an output shaft 18. The power tool 10 includes a releasably attached battery pack 25. The power tool 10 can include a trigger or control switch 11 that is in communication with the motor 15 and the battery 25. FIG. 1B illustrates an exploded view of the cordless power tool shown in FIG. 1A. A range of batteries with different voltage and/or current ratings may be held in a battery pack having substantially the same form factor. Thus, the battery pack 25 may releasably engage a range of different tool types. A single battery pack may be suitable for a subset of the range of tools.

Figure 2:
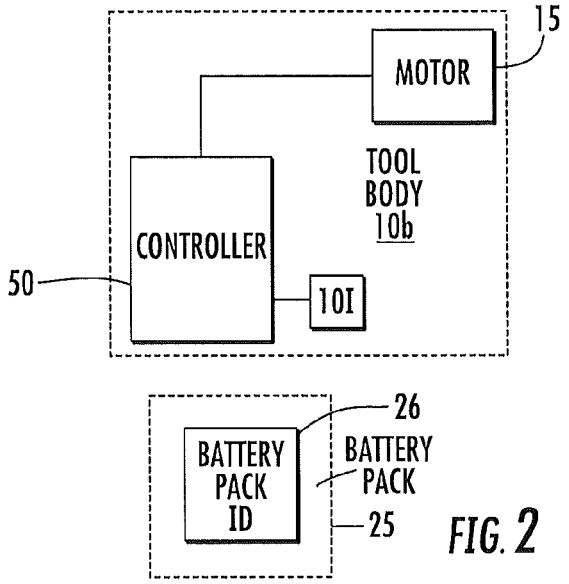
FIG. 2 is a schematic illustration of a power tool with a tool ID component and a battery ID component according to embodiments of the present invention.

A universal controller 50 with pre-defined different tool type operating modes can be used to control operation of the tool 10. The universal controller 50 is useable for a plurality of different cordless power tool types. The controller 50 can be held in the trigger or tool control switch 11. FIG. 2 illustrates that the tool body 10 includes the controller 50 and a tool identifier 10I while the battery pack 25 includes a battery pack identifier 26. The battery pack identifier 26 can cooperate with the battery's voltage and current output or capacity to generate a signal that the universal controller 50 uses to determine the battery characteristics based on pre-defined safety limits and operational loads, duty cycles, limits and the like.

Figure 1C:
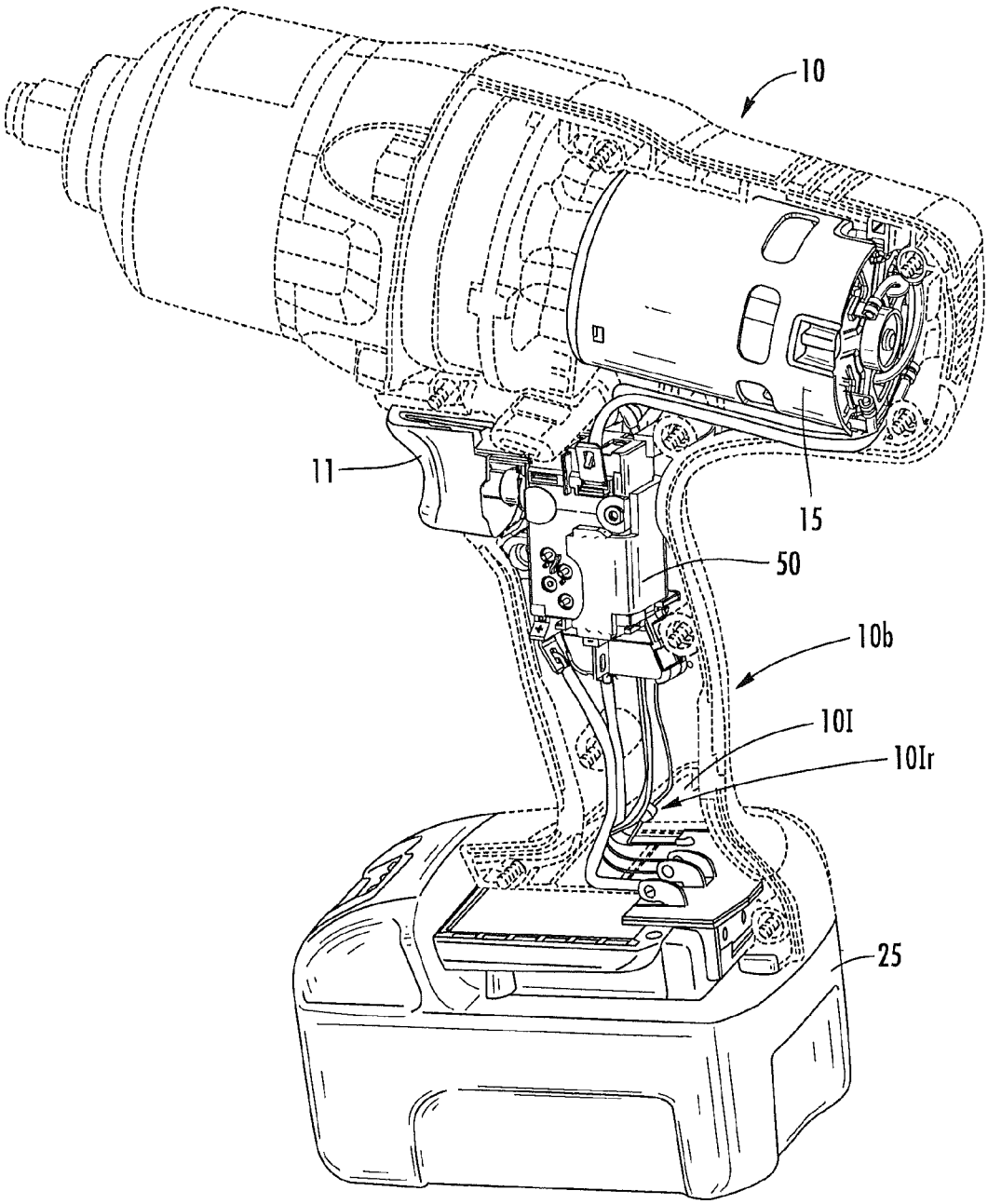
FIG. 1C is a partial cutaway view of the tool shown in FIG. 1B according to embodiments of the present invention.

The controller 50 can be the trigger switch 11 and can include or be in communication with the on-board tool ID 10I. Conventionally, a separate controller (e.g., DC switch) SKU would need to be available for each tool type. This tool ID 10I can be applied by an assembler during assembly of the tool 10, thus defining its tool type at a point of assembly. FIG. 1C illustrates that the tool ID 10I can comprise a resistor 10Ir located between the controller 50 and the battery pack 25 in the handle of the tool body 10*b*.

The battery pack identifier 26 can be any suitable electronic (typically analog) component including a resistor, inductor or capacitor or combinations thereof. Typically, the component comprises a resistor 26*r*. Similarly, the tool identification electronic (typically analog) component 10I, can comprise a resistor, capacitor, inductor, or combinations of the same. The tool identifier 10I also typically comprises a resistor 10Ir.

The battery pack 25 can be provided at assembly with the identifier already loaded and assembled. However, the tool identifier 10I can be placed in the tool body 10*b* during assembly, typically at an OEM (original equipment manufacturer or licensee thereof), so that it is in communication with (e.g., attached to) the controller 50 in the power tool.

Figure 3:
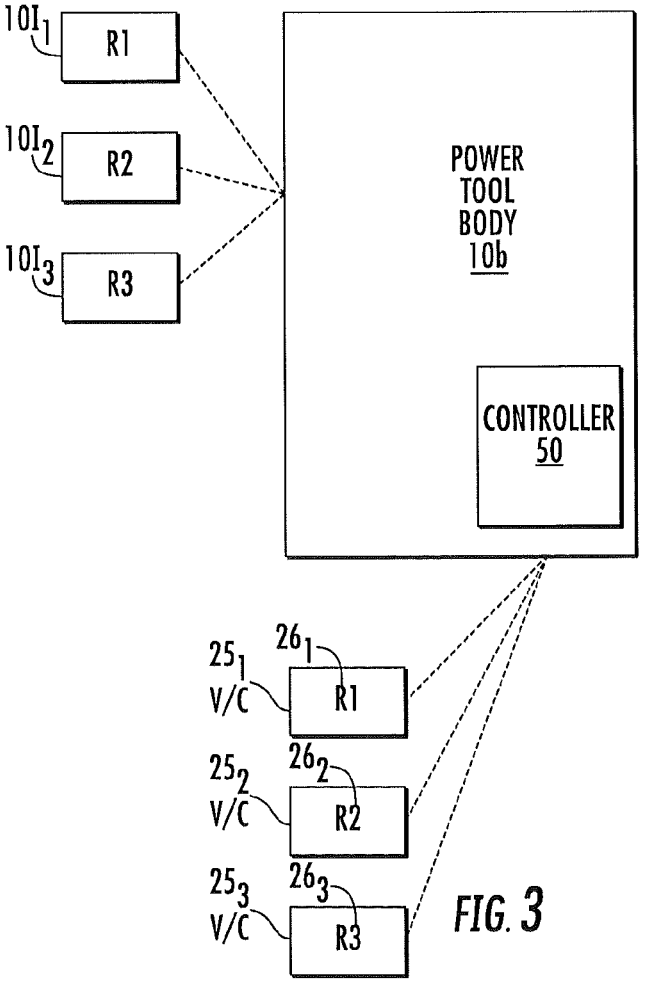
FIG. 3 is a schematic illustration of a power tool that allows a tool-specific ID component to be applied during assembly of the power tool according to embodiments of the present invention.

Thus, for example, as shown in FIG. 3, a resistor 10Ir having a defined resistor value R (one of a defined set or range of different resistor values such as R1, R2, R3) can be attached to the controller 50 in the power tool body 10*b* that is then used by the controller 50 to electronically identify the tool type and select the appropriate operating mode using associated defined operational parameters and limits particular to the tool type and battery pack 25. Different battery packs 25 having substantially the same form factor (shown as packs $\mathbf{25}_1$, $\mathbf{25}_2$, $\mathbf{25}_3$) with associated voltage/current parameters (V/C) and different defined resistor values R1, R2, R3 for the battery IDs ($\mathbf{26}_1$, $\mathbf{26}_2$, $\mathbf{26}_3$). The universal controller 50 can identify the tool type and battery characteristics to select the proper operating control parameters.

It is noted that the resistor R selected as the tool ID 10I to define the specific tool type can be two or more resistors such as R1 and R2. In some embodiments, a single resistor R value is used for the tool specific ID 10I. In this embodiment, the same part number for the tool ID can be used as a single resistor value is all that is needed. An assembler can simply assemble different amounts of the resistor R to define the tool type, e.g., one resistor for one tool type, two for another, three for yet another and the like.

The controller 50 can be configured to identify when a mismatch of battery ID 26 and tool ID 10I, are used and inhibit operation or generate an assembly alert error (on a display and/or audibly). This mismatch can be based on a correlation table of acceptable battery characteristics or battery identifiers for a tool type.

In some embodiments, the tool identifier 10I is held by the control or trigger switch 11, this allows for one switch design to adapt behavior to a range of tools. The tool switch or trigger 11 which can be described as a tool controller 50, in order to protect the motor 15, may be configured to apply power limits or modify operation, based on the specific tool type associated with the tool ID 10I, not just the battery ID 26.

The values of the electronic identifier component 26 and 10I (e.g., resistor) can vary and can be configured so that different tool types have sufficient detectable values, e.g., R1, R2, and R3, in increments of at least 0.01% and/or at least about 0.1 Ohms. Thus, R1, R2 and R3 can be in the 5-10 Ohm range, with increments of at least about 0.3. In particular embodiments, the R1-R3 values can be between about 5.620 Ohms to about 8.660 Ohms, depending on the number of cells in the battery and/or maximum current time to shut-down for defined current thresholds. However, other increments for different IDs and/or other ID resistor values may be used, such as values between 10-10,0000 Ohms, for example, including, between 100 200 Ohms, 100-1000 Ohms, and 1000-10,000 Ohms and/or increments of 0.1, 0.2, 0.3, 0.4, 0.5, or greater such as about 1, about 10, about 100, about 1000 and even greater, such as about 10,000.

Operational limits can be defined for each tool and specific battery model combination. Where scalar factors are used based on the resistor ID values, the one with the lowest threshold can determined the scalar used, e.g., it can take priority (battery vs. tool ID).

Figure 4:
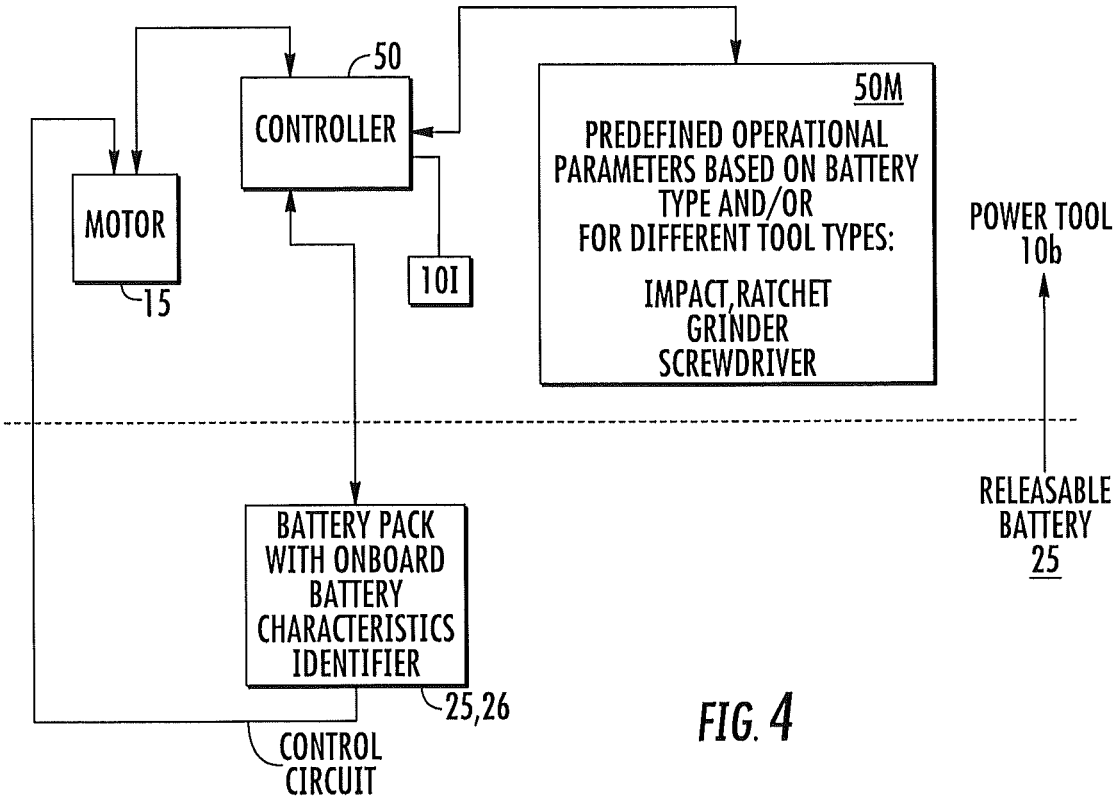
FIG. 4 is a schematic illustration of a circuit for a power tool having a plurality of different operational modes for different tool types according to embodiments of the present invention.

FIG. 4 illustrates that the power tool has a controller 50 that includes or communicates with a module 50M that has a set of predefined operational parameters for different battery characteristics and/or tool types.

Figure 5A:
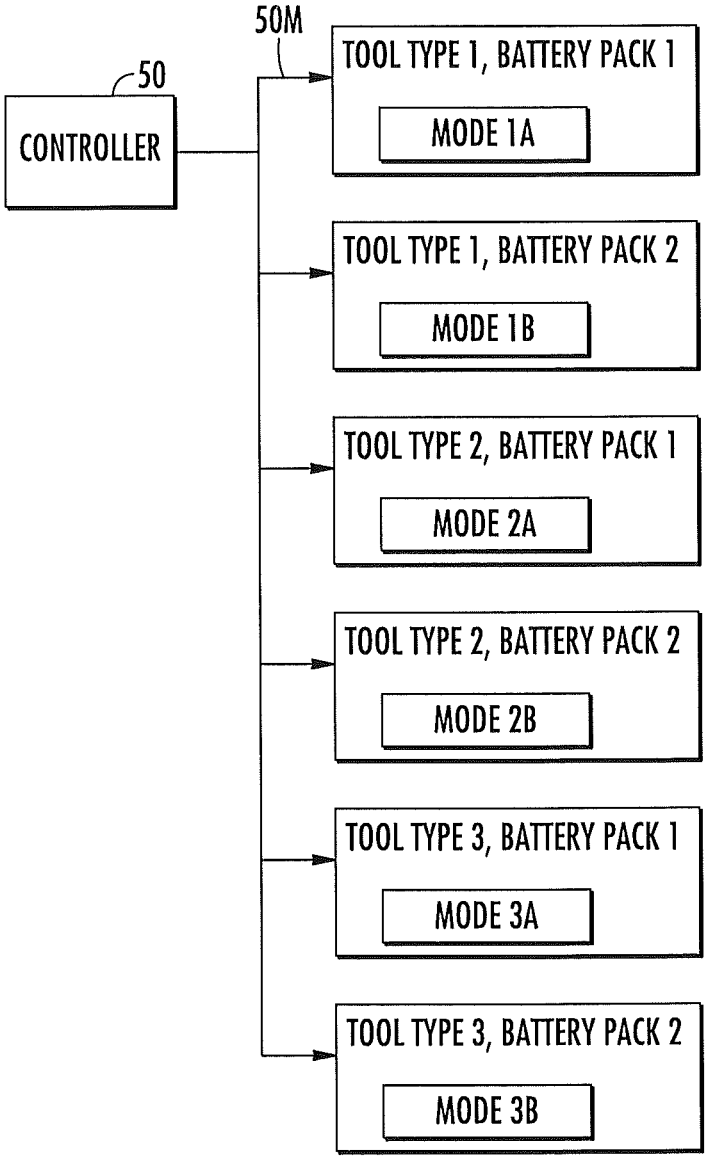
FIG. 5A is a schematic illustration of a controller that is in communication with a computer module that defines a plurality of different operational modes correlated to a detected tool type ID and a battery pack ID according to embodiments of the present invention.

FIG. 5A illustrates that the (universal) controller 50 is in communication with a module 50M (which may be on-board the trigger switch 11 or located in other components such as a PCB in the tool body 10*b*) that defines a set of different operational modes, mode 1A, 1B, 2A, 2B, 3A, 3B, for example, for different combinations of different tool types and battery packs with different characteristics. Thus, the controller 50 selects which of the plurality of different operational modes correlated to a detected tool type ID and a battery pack ID according to embodiments of the present invention.

Figure 5B:
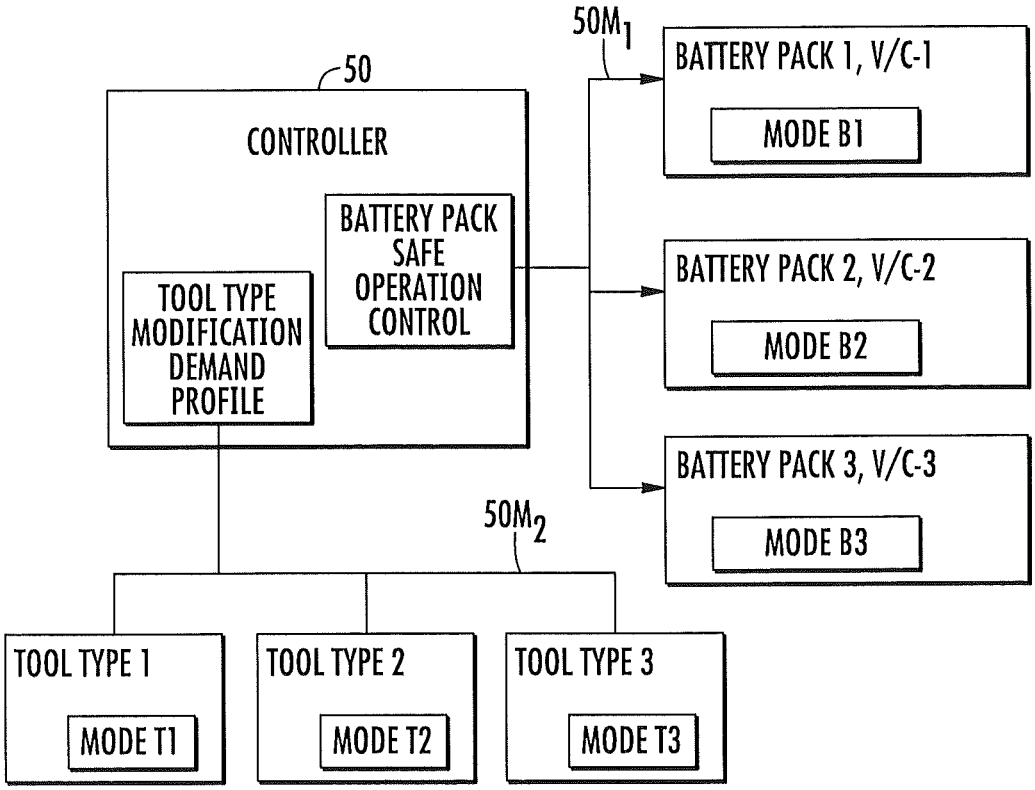
FIG. 5B is a schematic illustration of a controller having a tool ID operational module and a battery pack operational module, each correlated to a specific ID that defines the tool type and battery characteristics, respectively, according to embodiments of the present invention.

FIG. 5B illustrates the controller 50 having a battery pack ID operational module 50$M_1$ with battery packs identified as having different V/C characteristics, e.g., mode B1, B2, B3 and a tool ID pack operational module 50$M_2$, with tool operating modes defined by respective tool type T1, tool type T2, tool type T3 and the like. Each tool and battery mode correlated to a specific ID 10I, 26, respectively, that defines the tool type and battery characteristics for the controller 50 to run an appropriate operating mode (e.g., with motor stall or shut off protection). The controller 50 can be configured to first identify the battery characteristics using the battery pack ID 26 to select corresponding safe operating parameters, then further modify those parameters based on the tool ID 10I.

In some embodiments, the operational modes for different tool types define how to detect motor stall with certain defined reactions for safety or operational protection of that tool type (tool protection, battery life and the like). For example, impact wrenches, drill drivers and ratchets all have different operational characteristics. FIGS. 9A-9D illustrate exemplary current draw profiles associated with different tool types. The current amperage shown and duty cycles for each tool are by way of example and can vary based on cordless tool size and application.

Impact wrenches rarely stall during typical operation and the impact wrenches also employ a substantially constant (steady state) current, such as between 20 A to about 60 A, depending on the tool size. The tool can be configured to only shut down when there is a major event, such as in the unlikely event of a failed gear or the like. Thus, the shut down rule can be such that the tool or motor is shut down when the current is above the upper steady state current, e.g., such as at 70 A, typically at or above about 100 A for more than 1 second. Lower current thresholds (but above max steady state conditions) and shorter or longer stall time definitions may be used.

Drill drivers go into stall quite often (in contrast to the impact wrenches) due to their normal mode of operation, which is to fasten screws and the like. The tool is allowed to go into a motor stall condition for between 300-500 ms in normal operation to allow a user to receive the tool reaction to output, e.g., proper tightening. Thus, to prevent a nuisance shut-off of the drill driver tool, the tool is allowed to go into motor stall for about 1 second before the tool automatically shuts the motor down (such as if a bit is stuck). Thus, the tool can allow the motor to draw current at about 70 A, at which time a stall is identified. However, the triggers remains on (tool still operative) so there is no premature motor stall, allowing a user time to self adjust to a reaction force associated with shorter stalls of a few hundred milliseconds (e.g., under about 500 ms).

For a ratchet cordless tool, events occur relatively quickly so the motor stall is based on a time from when current reaches a threshold level. Thus, for example, when the current reaches about 45 A, the tool will shut down within about 150 ms. Thus, the length of a defined stall time to shut off can be different (shorter than the impact and/or drill/driver) as the ratchet is typically associated with a longer handle and the auto-shut off before an actual motor stall can inhibit strong reaction forces. This time is based on an application-specific tool, thus shorter (100 ms or less) or longer (e.g., 175 ms, 200 ms, 225 ms, under 500 ms, and the like) motor stall time-out rules may be used.

Thus, in some particular embodiments, there can be two basic tool shutdown times, 1 second and 0.15 second, depending on the tool size and/or type. For each shutdown time delay, the tool ID resistor can be chosen accordingly. However, other tool shutdown times may be used for different cordless tools and each may have a different shut off time (corresponding to tool type and/or size).

Figure 6A:
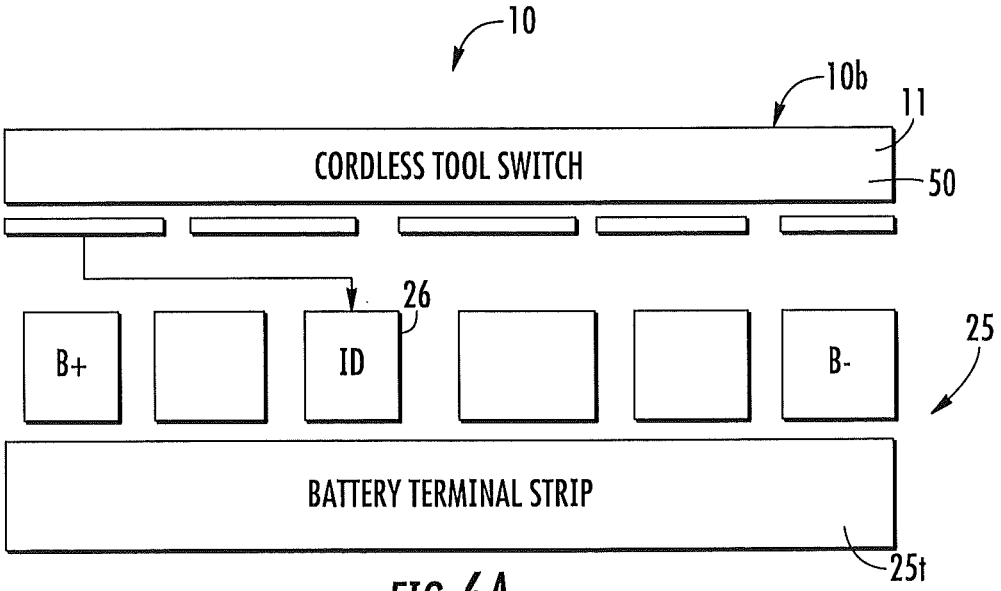
FIG. 6A is a schematic illustration of an exemplary circuit diagram according to embodiments of the present invention.

FIG. 6A illustrates a wiring or circuit diagram for a battery terminal block 25*t* and its communication with a cordless tool switch 11. In some embodiments, a specific resistor embedded in the battery terminal strip or block at a defined position (e.g., position 3) uniquely identifies the battery voltage and capacity to the switch 11. Once the battery is applied to a tool 10, the switch 11 can read the battery resistor value 26 and choose not to run, or run with limited power based on a defined protocol, e.g., electronic control parameters associated with an embedded module 50M in the controller 50 or in communication with the controller 50. Optionally, the module 50M for different tool type modes can be in a microprocessor in the (DC) switch itself 11. The resistor or other electronic identifier component can be attached to one or more of the connector ports or inputs on the switch. An exemplary switch manufacturer for cordless power tools is Marquardt Gmbh. Examples of power tool switches are described in U.S. Patent Application Publication Nos. 2010/0314147; 2006/0290306; and 2009/0200961, the contents of which are hereby incorporated by reference as if recited in full herein.

Figure 6B:
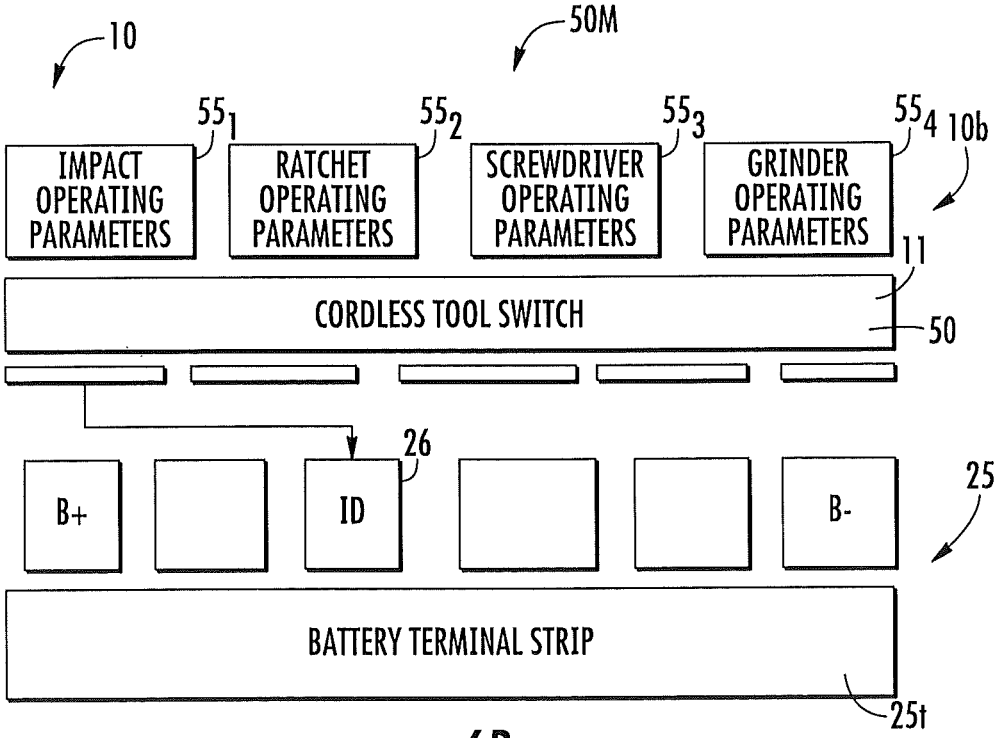
FIG. 6B is a schematic illustration of the diagram shown in FIG. 6A with on-board (in the power tool body) operation control modules for different tool types according to embodiments of the present invention.

FIG. 6B illustrates that the tool switch 11 is in communication with different selectable operating profiles $\mathbf{55}_1$, $\mathbf{55}_2$, $\mathbf{55}_3$, $\mathbf{55}_4$ for different tool types. Tool types such as impact, ratchet, grinder and screwdriver have distinctly different electrical current demand profiles. The switch 11 will apply the appropriate electrical current and time limits specifically tailored to that tool as specified in an on-board module 50M, e.g., provided as an embedded table.

Figure 6C:
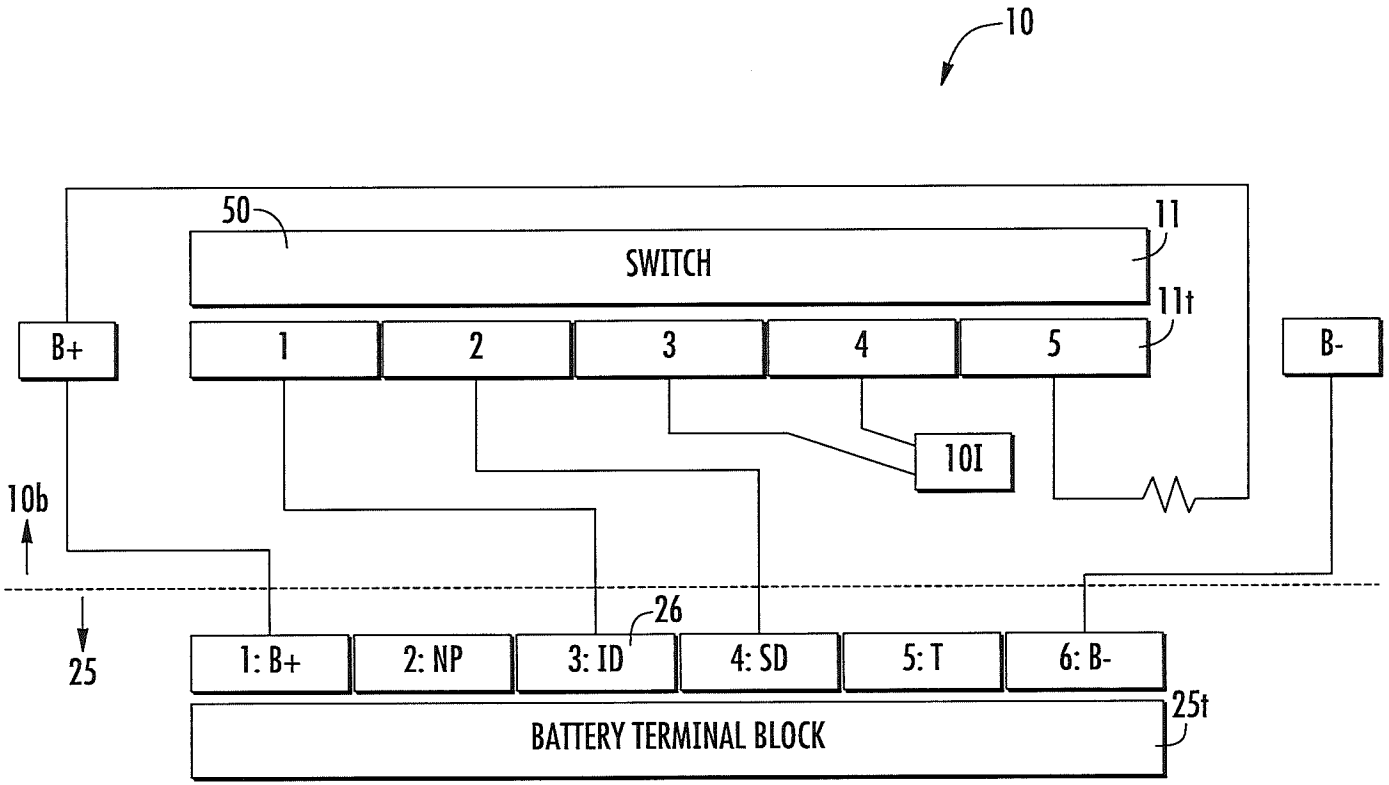
FIG. 6C is a schematic illustration of the diagram shown in FIG. 6A further illustrating that the controller/tool switch can include a Tool-ID component (e.g., resistor) used to define operational parameters according to embodiments of the present invention.

FIG. 6C illustrates that the ID component 10I can be a specific resistor value R that is applied to the switch 11 at power tool assembly to uniquely identify to the switch 11, the type of tool it is in. While the battery ID 26 is shown at terminal location 3 in FIG. 6C, and the tool type ID 10I is shown at positions 3 and 4 of the switch interface terminals, other locations or positions along the interface terminals may be used. As shown, the battery terminal strip or block 25*t* has 6 terminals but more or less may be used. Similarly, the switch 11 is shown with four terminals 11*t*, but more or less may be used. Further, although the switch terminal interface 11*t* has a fewer terminals than the battery terminals 25*t*, it may be configured with the same or more than the battery pack 25.

In the embodiment shown in FIGS. 6A-6C, position 1 of the battery terminal can be for the battery positive voltage while position 6 can be for the battery negative voltage. Position 2 is not required for active use. Position 3 can be for the ID 26 that allows for battery voltage/current output identification signal. Position 4 can be for a shutdown signal (SD). Position 5 can be for a battery temperatures signal (T). These terminal positions and uses are exemplary only and other locations or uses can be provided with more or less terminals.

As noted above, in some embodiments, a set of different electronic component values, typically resistors with different values, for different tool types can be defined. During assembly, a specific electronic component value 10I (e.g., resistor value) for that tool 10 being assembled can be applied to the controller 50 (e.g., connected to the switch 11 and/or provided as a defined circuit component or otherwise communicate with the controller) to uniquely identify to the controller 50, the type of tool device it is in. Thus, the specific ID value is used by the controller 50 to uniquely identify to the controller 50, the type of tool device 10 it is in to define it's safe operating parameters and its demand profile. Tool types such as impact, ratchet, grinder, screwdriver have distinctly different electrical current demand profiles (see, e.g., FIGS. 9A-9D). The controller 50 can apply the appropriate operating parameters including, for example, current and time limits, that are defined and tailored to that tool as correlated to the tool ID 10I defined by the selected electronic component value and the battery characteristics based on the battery ID 26.

The controller 50 can be pre-programmed with a module 50M (or more than one module) that can be provided as a library or electronic menu of a plurality of different tool type operating parameters, including, for example, a respective tool's safe operating area and its demand profile. The controller 50 can electronically apply the appropriate operational outputs, such as, for example, current and time limits specifically tailored to that tool 10 as specified or defined in an electronic library or other module configuration 50M, typically included as an embedded programmatically accessible table matched to the tool ID 10I.

Alternatively, one or more operating limit values of the tool 10 may be scaled directly from the electronic component value, e.g., resistor value, assembled to the tool, according to some predetermined and programmed scaling factor. The controller 50 may be configured to calculate current threshold and time to shut down proportional to the electronic component, e.g., resistor value(s). The scaling factor can be predetermined and programmed in the controller 50 or in a remote or on-board circuit accessible by the controller 50.

TABLE 2

Examples of Current Shutdown for Tool ID (resistor) value.
For values >5 kOhm, 1 second shutdown per the following calculation:
Resistor = (Amps * 40) + 5k Ohms

| Model | Current Shutdown (A) | Theoretical Resistor (Ohms) | Standard Option (Ohms) |
|---|---|---|---|
| Drill/Driver | 70 | 7800 | 7870 |
| Impact 1 | 100 | 9000 | 9090 |
| Impact 2 | 100 | 9000 | 9090 |

To facilitate proper assembly, the electronic component used for the tool ID can be color-coded to inhibit misassembly so that the correct tool type ID component 10I (e.g., R) is attached to the controller 50 (e.g., tool or trigger switch or other control circuit component) for a respective tool type. The color coding can be on production assembly instructions, assembly drawings, and/or on the tool body 10*b* itself. For example, color indicia visually accessible during assembly can be provided in any appropriate manner, including, for example, paint, tape, label or strip on the tool body 10 (internal wall or external). The tool body color-coding (where used) can be temporary or permanent and may reside proximate the battery pack attachment location. Color coding the electronic component to the tool can also help with easy quality control inspections for proper tool ID 10I to tool 10.

As noted above, in some particular embodiments, the electronic component defining the tool ID 10I can reside in a trigger switch 11 or other component accessible during assembly.

A specific electronic component 26 (e.g., resistor) value embedded in the battery pack 25 can uniquely identify the battery voltage and capacity to the controller 50. Once the battery pack 25 is assembled to the tool body 10*b*, the controller can read the battery component identifier value 26 (e.g., resistor value) and choose not to run, or run with limited or full power. This operational decision can be based on defined operational parameters in the tool body, e.g., as for the tool ID, using, for example, a module 50M with an embedded or programmed table or other electronic operational correlation data. Alternatively, as noted above, the tool can operate using a scaling factor associated with the battery pack identifier value.

It is contemplated that, in some embodiments, the battery pack 25 can employ a voltage or current identification signal using a resistor value R of the ID 26 and based on a specific pack voltage/current output such as, for example, about 10.8V/23 amps, about 10.8V/46 amps, about 18.0V/23 amps and the like. This signal can be generated using a battery negative referenced signal (B−).

Once a battery pack 25 is assembled to a battery operated tool 10, the controller 50 of the tool can electronically read the battery pack electronic identifier 26, e.g., resistor, held in the battery pack (typically associated with a connector output port on a terminal block) which identifies the battery characteristics, including voltage, current and capacity. The battery characteristics are predefined and correlated to the battery ID 26 to allow the controller 50 to select the corresponding operational mode, e.g., which sets outer limits of performance for the safe operation. The controller 50 can also read the tool identification component 10I, e.g., resistor, which was applied during device assembly. Thus, the controller 50 identifies the tool device type and demand profile that the controller is being applied to.

To be clear, although one controller 50 is shown, more than one controller 50 or a controller with more than one microprocessor may be used to carry out features of the present invention.

Embodiments of the present invention may take the form of an entirely software embodiment or an embodiment combining software and hardware aspects, all generally referred to herein as a "circuit" or "module." The module may be a software implemented set of instructions or directions that direct the power tool how to operate or to control operation to be within certain defined standards for different tool types.

Furthermore, embodiments of the present invention may take the form of a computer program product on a computer-usable storage medium having computer-usable program code embodied in the medium. Any suitable computer readable medium may be utilized including hard disks, CD-ROMs, optical storage devices, a transmission media such as those supporting the Internet or an intranet, or magnetic storage devices. Some circuits, modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed digital signal processor or microcontroller. Embodiments of the present invention are not limited to a particular programming language.

Computer program code for carrying out operations of data processing systems, method steps or actions, modules or circuits (or portions thereof) discussed herein may be written in a high-level programming language, such as Python, Java, AJAX (Asynchronous JavaScript), C, and/or C++, for development convenience. In addition, computer program code for carrying out operations of exemplary embodiments may also be written in other programming languages, such as, but not limited to, interpreted languages. Some modules or routines may be written in assembly language or even micro-code to enhance performance and/or memory usage. However, embodiments are not limited to a particular programming language. It will be further appreciated that the functionality of any or all of the program modules may also be implemented using discrete hardware components, one or more application specific integrated circuits (ASICs), or a programmed digital signal processor or microcontroller.

The present invention is described in part with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing some or all of the functions/acts specified in the flowchart and/or block diagram block or blocks.

The flowcharts and block diagrams of certain of the figures herein illustrate exemplary architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order or two or more blocks may be combined, depending upon the functionality involved.

Figure 7:
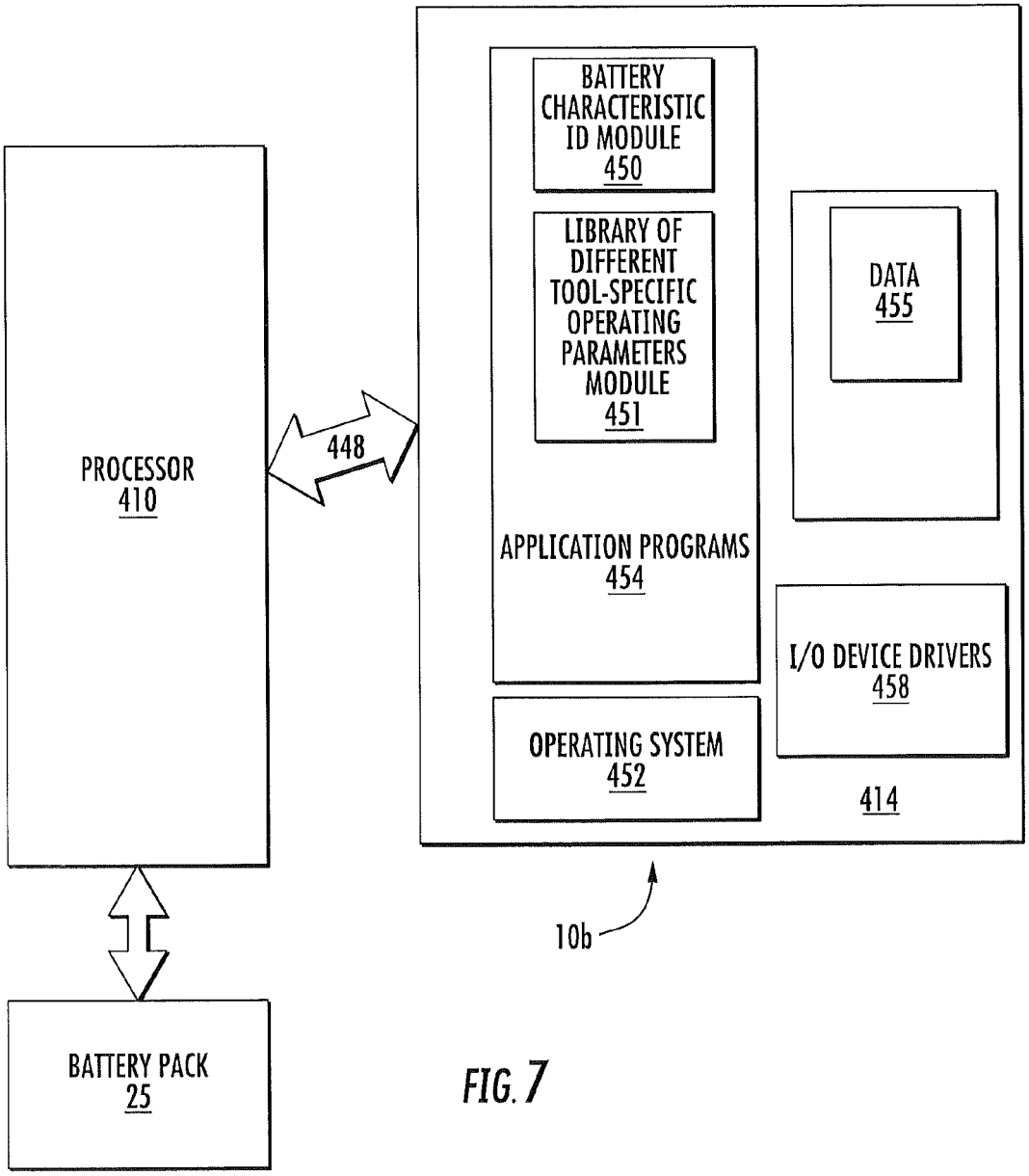
FIG. 7 is a schematic illustration of a data processing system according to embodiments of the present invention.

FIG. 7 is a schematic illustration of a circuit or data processing system that can be used with the controller and/or control circuit of the cordless power tool. The circuits and/or data processing systems may be incorporated in a digital signal processor in any suitable device or devices. As shown in FIG. 7 the processor 410 is held in the cordless power tool and includes memory 414 that communicates with the processor via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

FIG. 7 illustrates that the memory 414 may include several categories of software and data used in the data processing system: the operating system 449; the application programs 450, 451; the input/output (I/O) device drivers 458; and data 456. The data 456 can include device (tool-specific) operational controls or limits for each tool. FIG. 7 also illustrates the application programs 454 can include a Battery Reader Module 450, and a Library of Different Tool-Specific Operating Module 451. These modules may be provided as separate modules or combined.

As will be appreciated by those of skill in the art, the operating systems 452 may be any operating system suitable for use with a data processing system, such as OS/2, AIX, or zOS from International Business Machines Corporation, Armonk, N.Y., Windows CE, Windows NT, Windows95, Windows98, Windows2000, WindowsXP, Windows Visa, Windows7, Windows CE or other Windows versions from Microsoft Corporation, Redmond, Wash., Palm OS, Symbian OS, Cisco IOS, VxWorks, Unix or Linux, Mac OS from Apple Computer, LabView, or proprietary operating systems.

The I/O device drivers 458 typically include software routines accessed through the operating system 449 by the application programs 454 to communicate with devices such as I/O data port(s), data storage 456 and certain memory 414 components. The application programs 454 are illustrative of the programs that implement the various features of the data processing system and can include at least one application, which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the Modules 450, 451 being application programs in FIG. 7, as will be appreciated by those of skill in the art, other configurations may also be utilized while still benefiting from the teachings of the present invention. For example, the Modules and/or may also be incorporated into the operating system 449, the I/O device drivers 458 or other such logical division of the data processing system. Thus, the present invention should not be construed as limited to the configuration of FIG. 7 which is intended to encompass any configuration capable of carrying out the operations described herein. Further, one or more of modules, i.e., Modules 450, 451 can communicate with or be incorporated totally or partially in other components, such as separate or a single processor or different circuits in the housing of the tool, such as, for example, in the switch 11.

The I/O device drivers typically include software routines accessed through the operating system by the application programs to communicate with devices such as I/O data port(s), data storage and certain memory components. The application programs are illustrative of the programs that implement the various features of the data processing system and can include at least one application, which supports operations according to embodiments of the present invention. The data represents the static and dynamic data used by the application programs, the operating system, the I/O device driver and the like.

Figure 8:
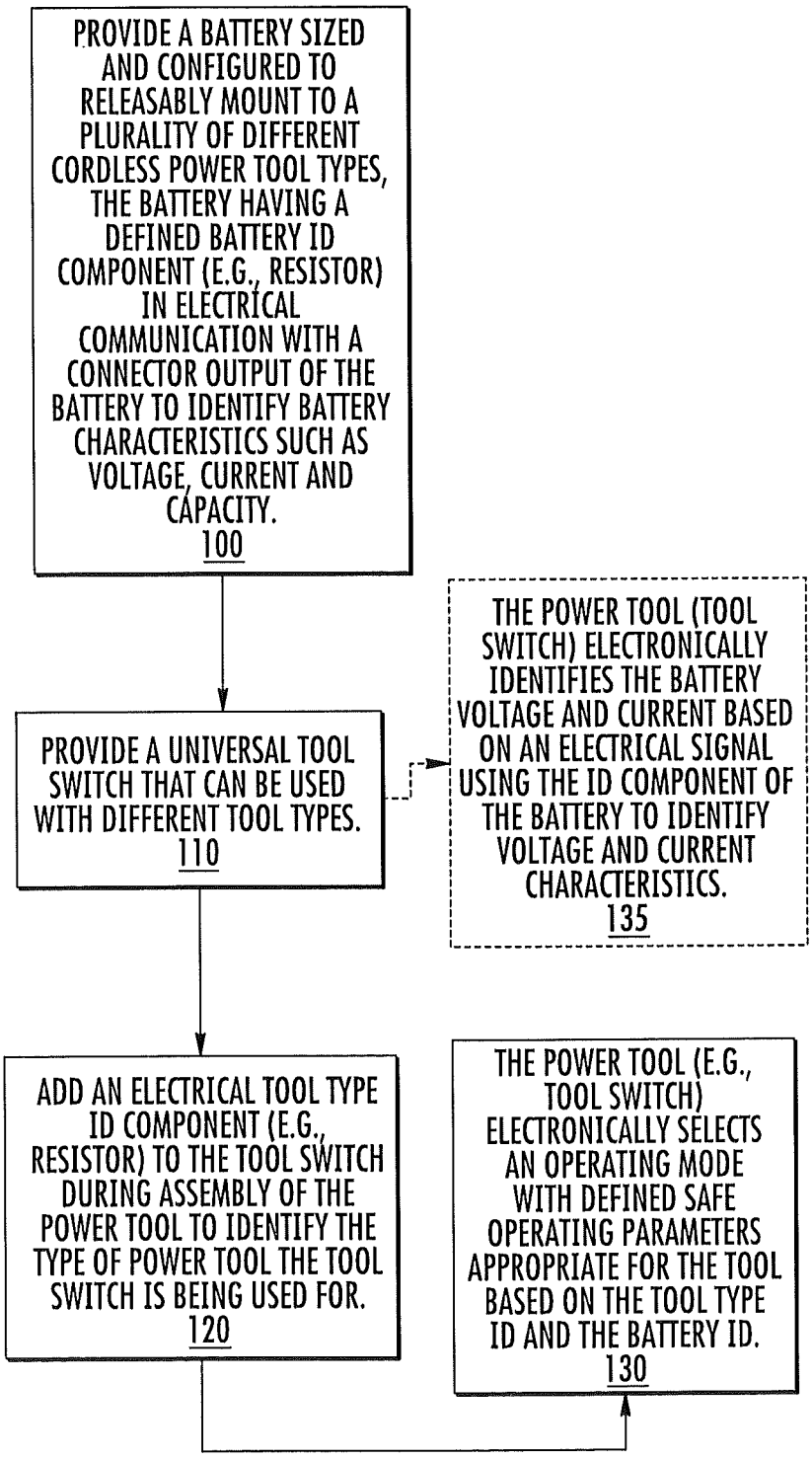
FIG. 8 is a flow chart of exemplary assembly methods according to embodiments of the present invention.
Figure 9A:
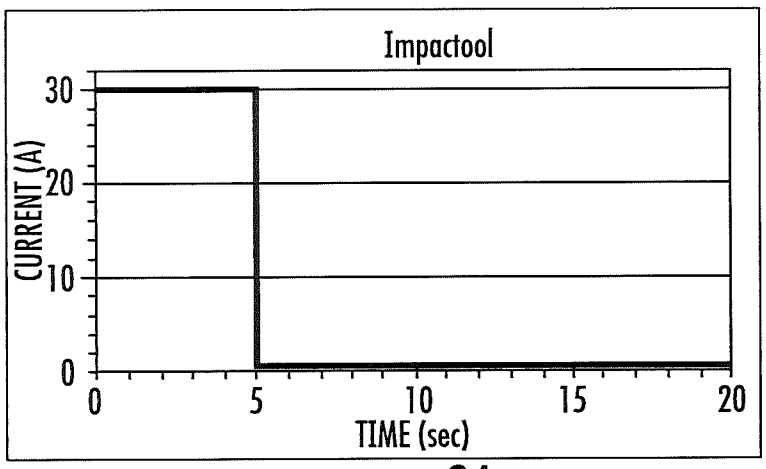
FIGS. 9A-9D are graphs of examples of current draw profiles for different cordless tool types according to embodiments of the present invention.
Figure 9B:
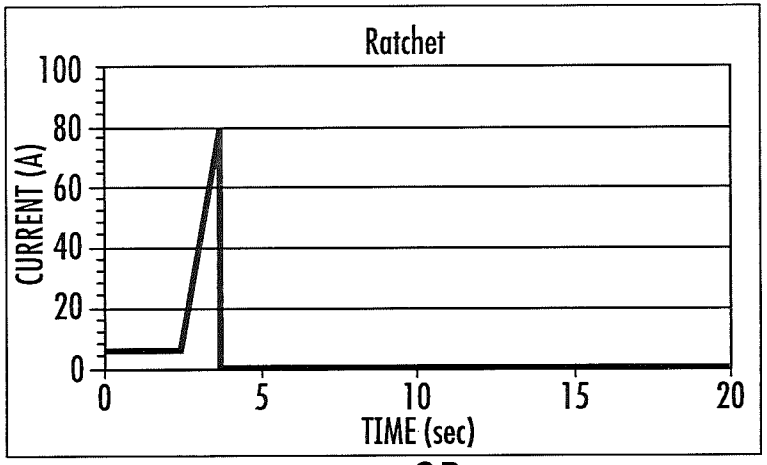
Figure 9C:
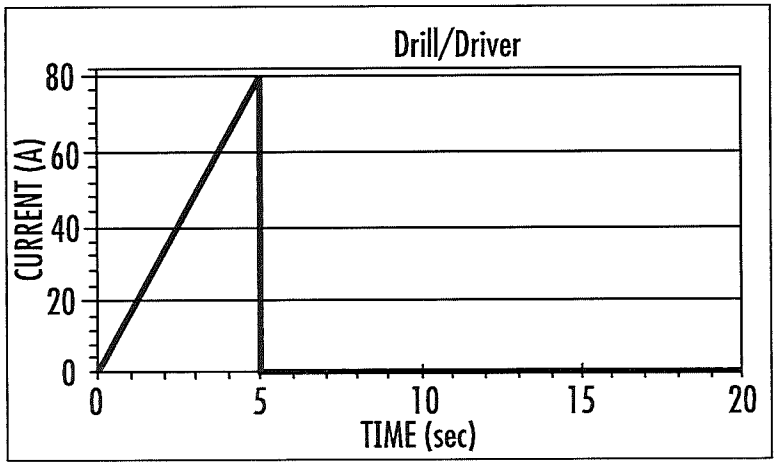
Figure 9D:
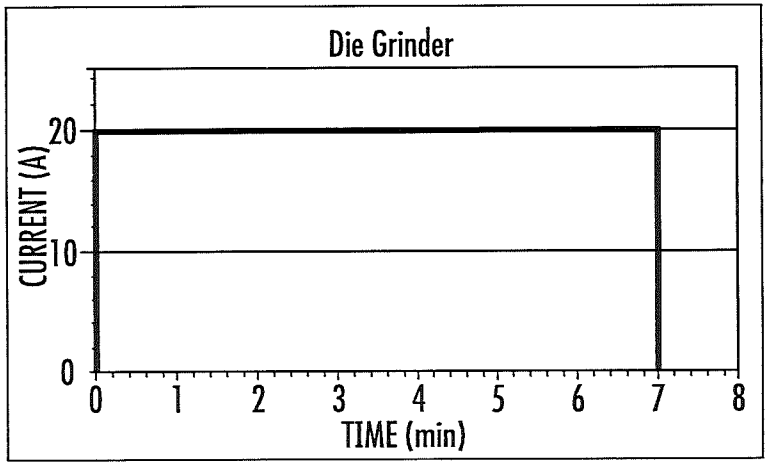

FIG. 8 is a flow chart of exemplary steps that can be used to carry out embodiments of the present invention. A battery pack sized and configured to releasably mount to a plurality of different cordless power tool types is provided, the battery having a defined battery ID component (e.g., resistor) in electrical communication with a connector output of the battery to identify battery characteristics such as voltage, current and capacity (block 100). A universal tool switch is provided that can be used with different tool types (block 110). An electrical tool type ID component (e.g., resistor) is added/assembled to the tool switch during assembly of the power tool to identify the type of power tool the tool switch is being used for (block 120). The power tool (e.g., tool switch) electronically selects an operating mode with defined safe operating parameters appropriate for the tool based on the tool type ID and the battery ID (block 130).

The power tool (tool switch) can electronically identify the battery voltage and current based on a detected electrical signal from the battery pack using the ID component of the battery to identify voltage and current characteristics (block 135).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, if used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A handheld power tool, comprising:

a power tool body:

an electric motor held in the power tool body;

a universal controller in the power tool body in communication with the electric motor, the universal controller having or being in communication with an electronic component that defines a tool type identifier in the power tool body;

a battery pack releasably attachable to the power tool body, the battery pack having an on-board electronic identifier; and a trigger switch in communication with the electric motor and the universal controller, wherein the electronic component that defines the tool type identifier comprises a resistor held by or in communication with the trigger switch, wherein the trigger switch comprises a plurality of terminals, wherein the resistor defining the tool type identifier is electrically connected to a first and second terminal of the trigger switch, and wherein a third terminal is configured to be electrically connected to the on-board electronic identifier of the battery pack such that universal controller automatically selects an operational control mode based on the on-board electronic identifier and the tool type identifier, wherein the universal controller has a plurality of different operational control modes for a plurality of different tool types and a plurality of different battery packs with different battery characteristics, and wherein the controller automatically selects an appropriate control mode based on the tool type identifier and the on-board electronic identifier, wherein the universal controller automatically selects a first operational control mode when the battery pack is attached to the power tool body and wherein the universal controller is configured to automatically select a second operational control mode when a second battery pack having a second on-board electronic identifier is releasably attached to the power tool body.

2. The power tool of claim 1, wherein the battery pack identifier comprises a resistor, and wherein the controller comprises a control module that applies a scalar factor to operating parameters based on at least one of the tool type identifier or the battery pack identifier.

3. The power tool of claim 1, wherein the electronic component that defines the tool type identifier is configured to be attached to the trigger switch during assembly of the power tool such that, during assembly, a respective trigger switch has an open terminal that is reserved for the electronic component that defines the tool type identifier, the trigger switch being in communication with the battery pack.

4. The power tool of claim 1, wherein the power tool comprises a pistol handle portion, and wherein the tool type identifier is attached to the universal controller and resides in the pistol handle, and wherein the universal controller is configured to have at least three of the following: drill, impact, ratchet and screwdriver operational power tool modes.

5. The power tool of claim 1, wherein the universal controller is configured to identify battery pack and tool type mismatches and prevent operation of the power tool.

6. The power tool of claim 1, wherein a portion of the power tool body is color-coded to a color associated with the electronic component to aid in proper assembly selection.

7. The power tool of claim 1, wherein the universal controller is configured to electronically identify a resistor value of a resistor connected to the trigger switch or that forms part of the trigger switch that defines the tool type electronic identifier, and wherein the universal controller is configured to define at least one of a current shutdown limit and time to shutdown that is proportional to the resistor value.

8. A trigger switch assembly for a cordless power tool, comprising:

a trigger switch comprising a plurality of terminal inputs, wherein a first terminal input of the trigger switch is configured, during use, to be electrically connected with an on-board electronic identifier of a rechargeable battery, and wherein a second and third terminal input of the trigger switch is configured to be electrically connected with a tool type electronic identification component; and a universal controller in communication with terminal inputs of the trigger switch, the universal controller configured to electronically identify a tool type of a power tool using the tool type identification component, then select one of a plurality of pre-programmed operational modes based on the identified tool type and the on-board electronic identifier, wherein the universal controller is configured to select a different pre-preprogrammed operational mode based on the identified tool type and a second on-board electronic identifier of a second rechargeable battery pack when the second on-board electronic identifier is in electronic communication with the first terminal input.

9. The trigger switch assembly of claim 8, wherein the tool type identification component comprises a resistor.

10. The trigger switch assembly of claim 8, wherein the universal controller is configured to identify battery pack and tool type mismatches and prevent operation of a power tool having a mismatch.

11. The trigger switch assembly of claim 8, wherein, when assembled to a power tool body, the universal controller is configured to electronically identify battery characteristics of a rechargeable battery pack attached to the power tool body.

12. The trigger switch assembly of claim 8, wherein the universal controller is configured to electronically identify a resistor value of a resistor connected to the trigger switch or that forms part of the trigger switch, and wherein the universal controller is configured to define at least of a current shutdown limit and time to shutdown that is proportional to the resistor value.

13. A method of assembling a cordless power tool, comprising:

providing a trigger switch assembly adapted for use in a power tool body, the trigger switch assembly comprising a plurality of terminals, a control interface switch and a power tool controller in communication with at least one terminal of the switch assembly, wherein the trigger switch assembly is useable with a plurality of different power tool types, the controller having a plurality of defined operational modes for different tool types and different battery packs having an on-board electronic identifier, wherein the power tool controller is configured to electronically select a first operational mode for the power tool based on a first electronic tool identifier in the power tool body and a first battery pack identifier when the first electronic tool identifier is electronically connected to a first and second terminal of the trigger switch assembly and when the first battery pack identifier is electronically connected to a third terminal of the trigger switch assembly, and wherein the power tool controller is configured to electronically select a second operational mode for the power tool based on a second electronic tool identifier and a second battery pack identifier when the second electronic tool identifier is electronically connected to the first and second terminal of the trigger switch assembly and when the second battery pack identifier is electronically connected to a third terminal of the trigger switch assembly; and electronically connecting the first terminal of the trigger switch to the first electronic tool identifier.

14. The method of claim 13, further comprising allowing an assembler to place the first electronic, tool type identifier on the control interface switch that is electronically associated with a defined tool type, wherein the allowing step is carried out by allowing the assembler to select a resistor having a resistor value that identifies a corresponding tool type to the controller so that the controller can select the correct operational mode.

15. The method of claim 13, further comprising providing a plurality of different resistors having different resistor values, and allowing the assembler to select one of the plurality of different resistors that is associated with a respective tool type.

16. The method of claim 13, wherein the controller is configured to identify battery pack and tool type mismatches and prevent operation of the power tool.

17. The method of claim 13, wherein a portion of the power tool body is color-coded to a color associated with a corresponding tool type electronic component, and wherein the allowing an assembler step is carried out by the assembler placing the electronic component with a color that substantially matches the portion of the power tool body on the controller.

18. The method of claim 17, wherein the color-coded electronic component comprises a resistor, and wherein the controller is the control interface switch.

* * * * *